US005683018A

United States Patent [19]

Sullivan et al.

[11] Patent Number: 5,683,018

[45] Date of Patent: Nov. 4, 1997

[54] GARMENT HANGER WITH LOCKING INFORMATION CLIP

[75] Inventors: Scott L. Sullivan, Chappaqua, N.Y.; Walter Slezak, Clifton, N.J.; Morris Relson, Great Neck, N.Y.

[73] Assignee: Uniplast Industries, Inc., Hasbrouck Heights, N.J.

[21] Appl. No.: 394,655

[22] Filed: Feb. 22, 1995

Related U.S. Application Data

[63] Continuation-in-part of Ser. No. 197,286, Feb. 15, 1994, which is a continuation-in-part of Ser. No. 138,706, Oct. 18, 1993, Pat. No. 5,441,182, and Ser. No. 109,129, Aug. 19, 1993, abandoned.

[51] Int. Cl.[6] ..... A47G 25/14

[52] U.S. Cl. ..... 223/85; 40/322

[58] Field of Search ..... 223/85, 88, 92, 223/95; D6/315; 40/322; 24/625, 555

[56] References Cited

U.S. PATENT DOCUMENTS 4,115,940 9/1978 Phillips et al. ..... 223/85

4,997,114 3/1991 Petrou ..... 223/85

5,096,101 3/1992 Norman et al. ..... 223/85

*Primary Examiner*—Bibhu Mohanty

*Attorney, Agent, or Firm*—Darby & Darby

[57] ABSTRACT

This invention is directed generally to garment hangers of the type on which information clips may be locked, and, in particular, to garment hangers adapted to receive such a locking information clip so that its removal is prevented or strongly inhibited, and to the locking information clips themselves.

According to aspects of the present invention the information clip not only resiliently engages a ledge adjacent the edge of the clip holder, but in addition is provided to discourage or prevent moving the clip side walls apart to disengage the clip from the ledge. In certain forms of the invention, further assurance of non-removability is provided by engaging edges of the clip with engagement elements on the clip holder, without interfering with use of conventional molding for producing the hanger. In other forms of the invention, other arrangements are provided to retain the clip on the hanger by strongly inhibiting lifting one or both side walls of the clip by use of fingers or finger nails.

2 Claims, 12 Drawing Sheets

FIG. 1
PRIOR ART
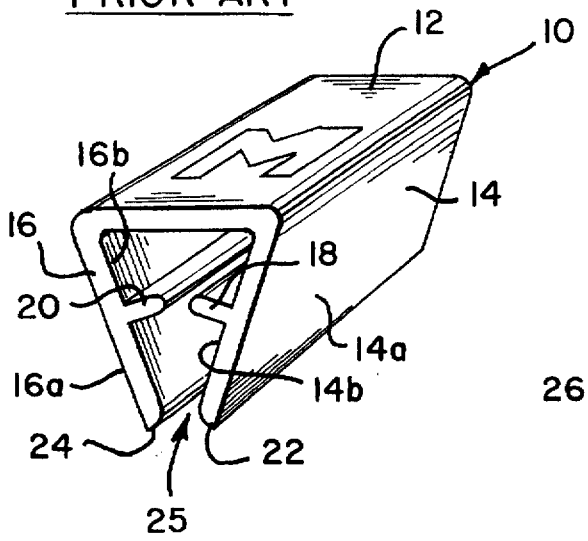
FIG. 2
PRIOR ART
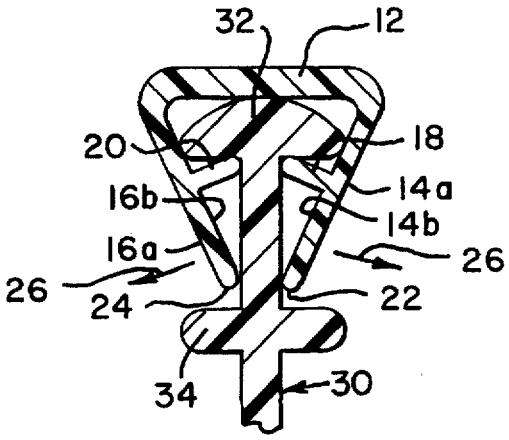
FIG. 3
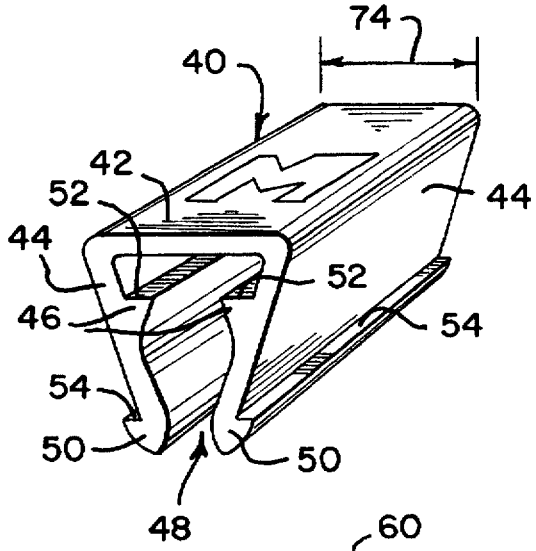
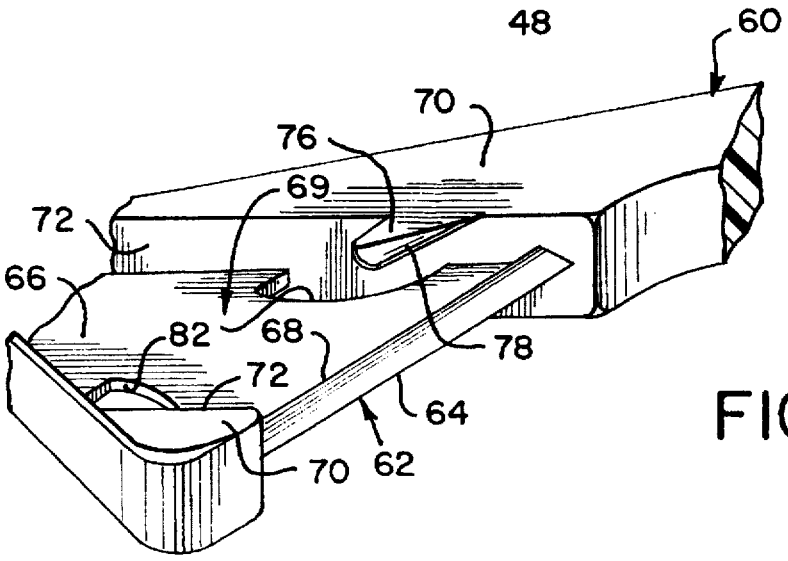
FIG. 4

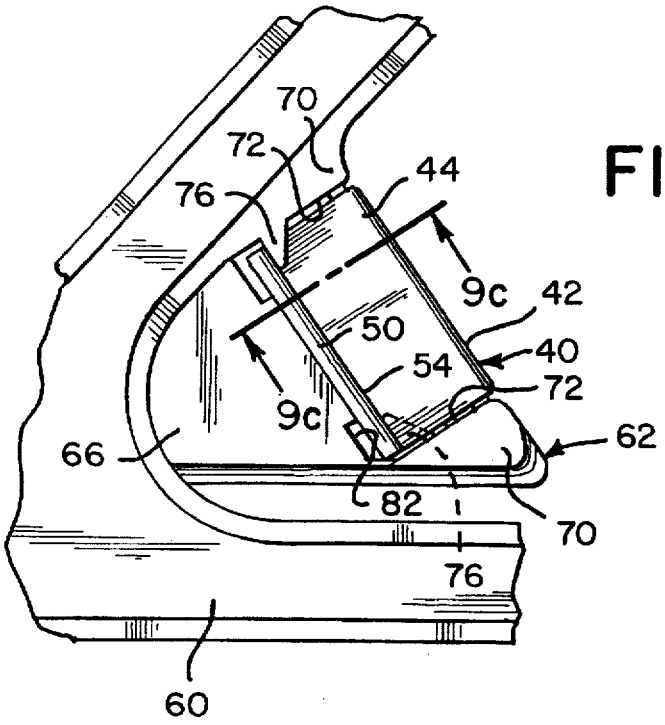
FIG. 8
FIG 9a
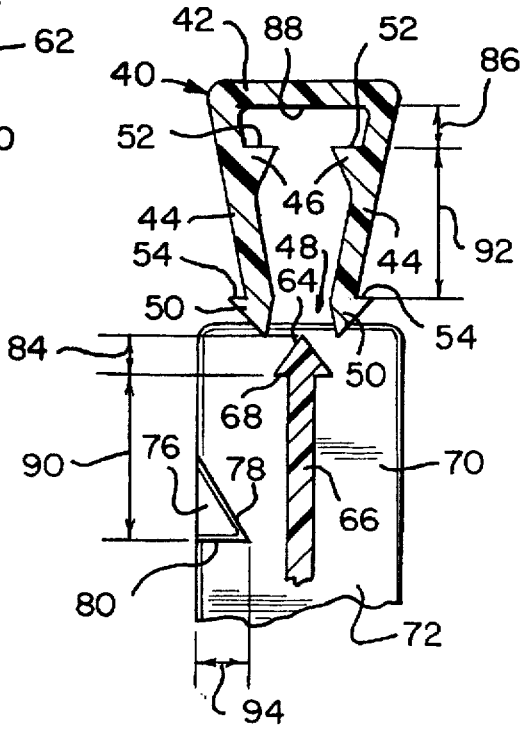
FIG. 9b
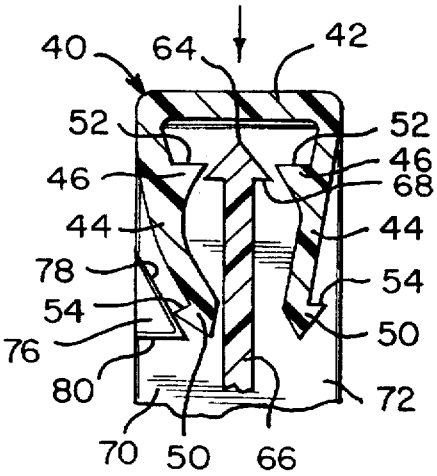
FIG. 9c
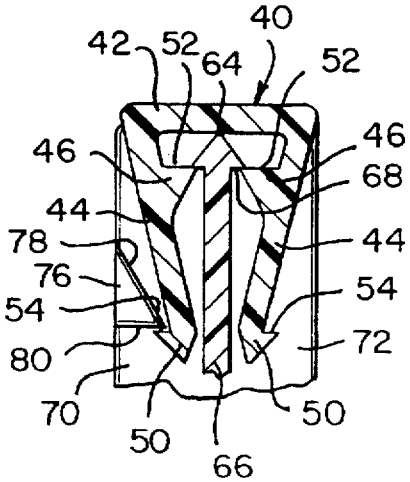

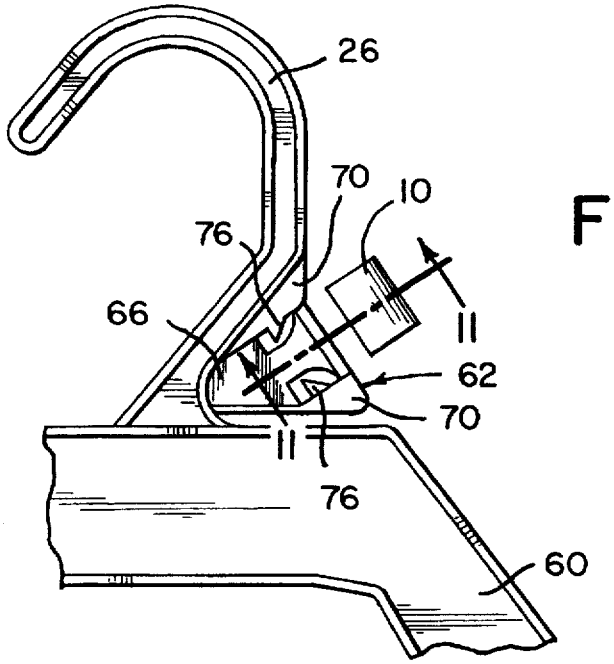
FIG. 10
FIG. 11
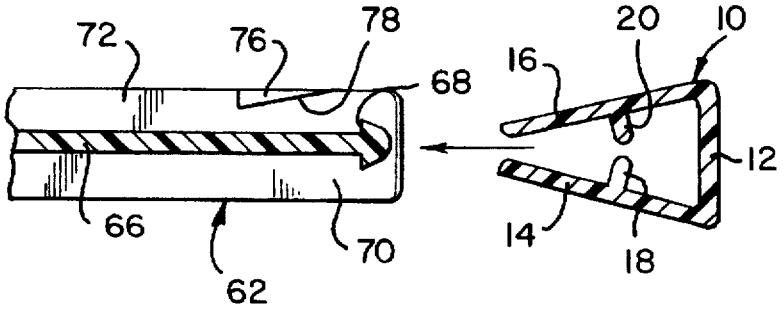
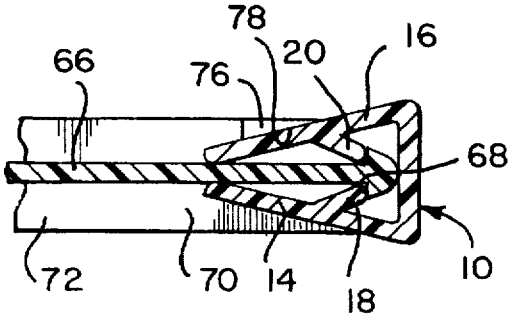
FIG. 12

FIG. 20A
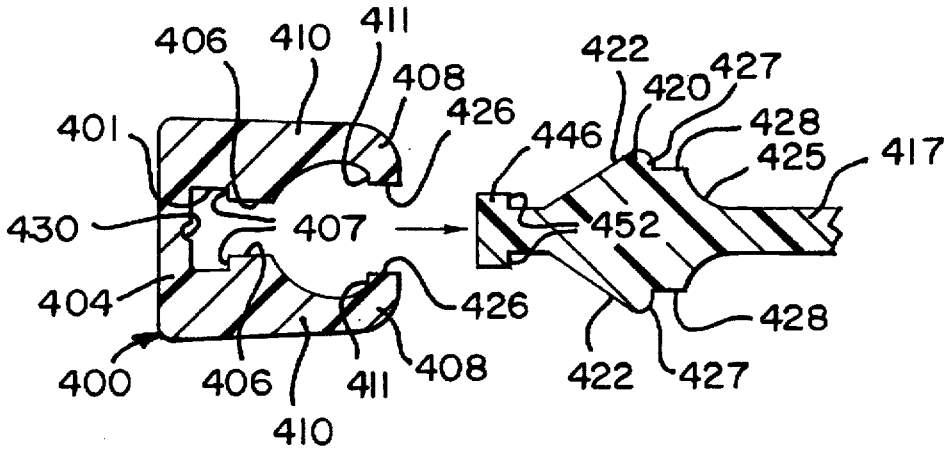
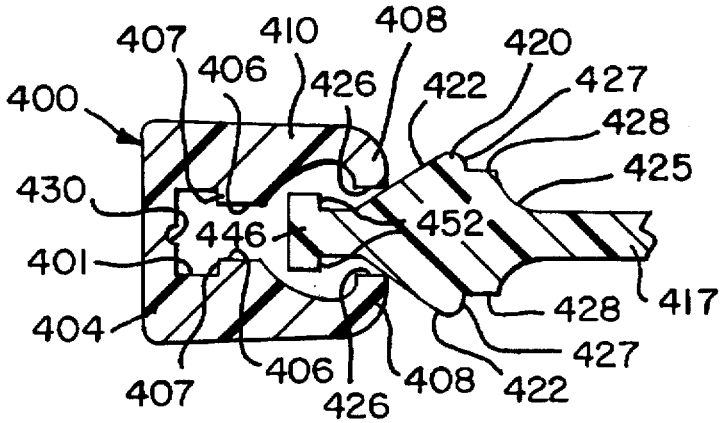
FIG. 20B
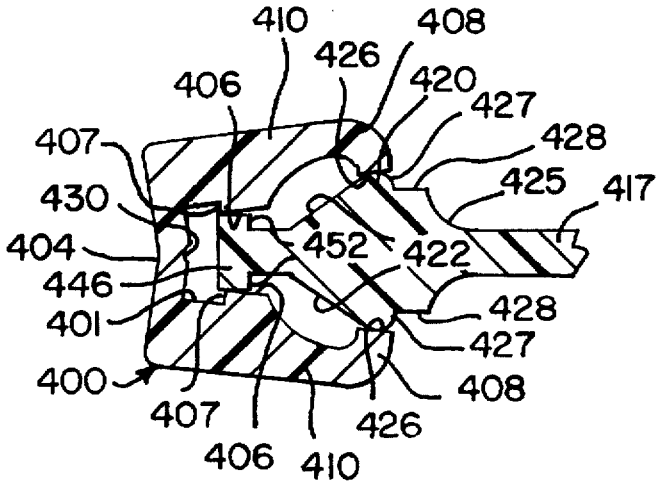
FIG. 20C

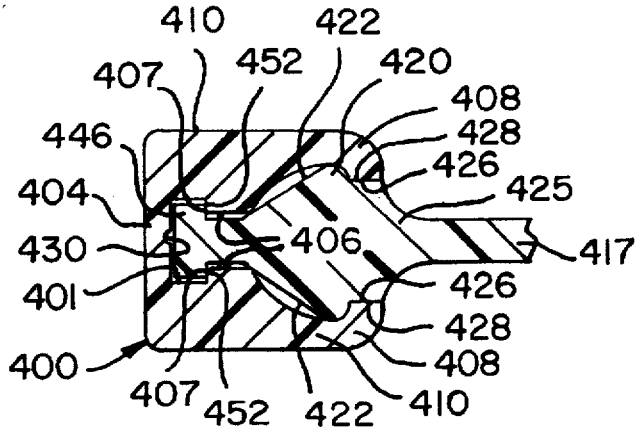
FIG. 20D
FIG. 21
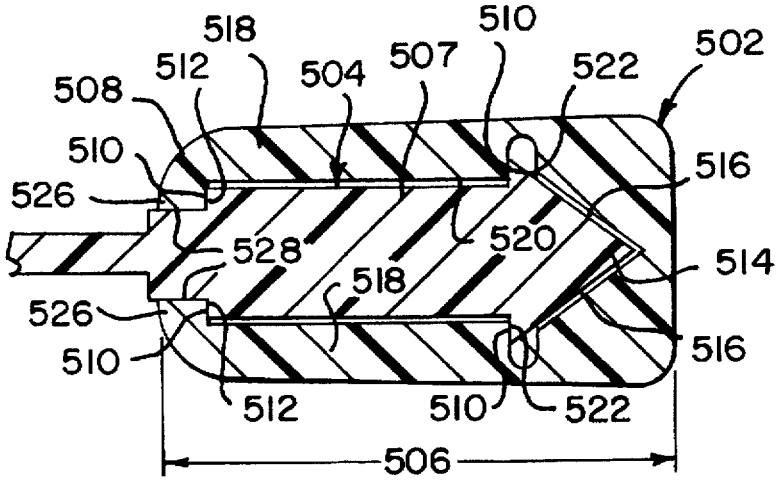
FIG. 22A
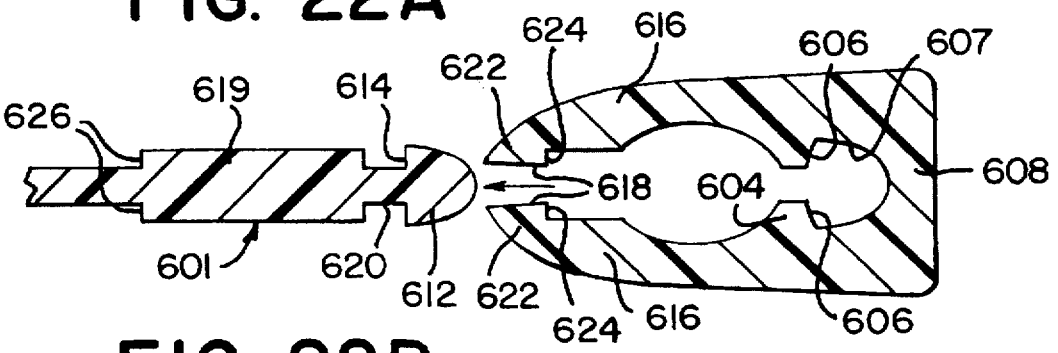
FIG. 22B
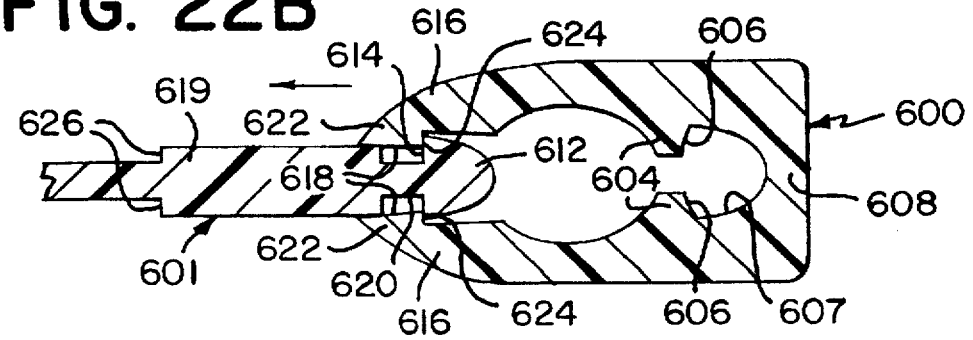

GARMENT HANGER WITH LOCKING INFORMATION CLIP

This is a continuation-in-part of U.S. patent application Ser. No. 08/197,286, filed Feb. 15, 1994 which is a continuation-in-part of U.S. patent application Ser. No. 07/138,706 filed Oct. 18, 1993 now U.S. Pat. No. 5,441,182 and of U.S. patent application Ser. No. 08/109,129 filed Aug. 19, 1993 now abandoned.

FIELD OF THE INVENTION

This invention is directed generally to garment hangers of the type on which information clips may be locked, and, in particular, to garment hangers adapted to receive such a locking information clip so that its removal is prevented or strongly inhibited, and to the locking information clips themselves.

BACKGROUND OF THE INVENTION

Garment hangers having information clips have been previously known and used. U.S. Pat, No. 4,115,940, for example, discloses a molded plastic garment hanger which includes a web-like clip-mounting member or holder which exposes a free edge onto which an information clip may be mounted. The information clip of the hanger disclosed in U.S. Pat. No. 4,115,940 is intended to be easily removable and therefore the hanger offers no element or feature to prevent or discourage information clip removal. Other disclosures of information clips for garment hangers include U.S. Pat. No. 3,949,914 issued Apr. 13, 1976; U.S. Design Pat. No. 244,197 issued May 3, 1977; and U.S. Pat. No. 4,997,114 issued Mar. 5, 1991.

Such easily removable information clips are quite satisfactory for appropriate applications. However, in view of the small size of such clips, which may be readily swallowed, and with increased concerns about child safety, especially when such garment hangers are taken home with the purchased garment, it becomes important to provide a garment hanger which prevents the accidental or ready removal of secured information clips. Also, where such clips may provide price information, it is desirable to inhibit or prevent even intentional removal, to minimize possible fraudulent interchange of clips.

U.S. Pat. No. 5,096,101 and U.S. Pat. No. 5,199,608 disclose garment hangers having lockable information clips. The garment hangers disclosed in these two patents include elements which discourage, but do not fully prevent, removal of a secured information clip. These hangers are discussed below with respect to FIGS. 1 and 2 (labeled "Prior Art").

Accordingly, it is a principal object of the invention to provide a garment hanger adapted to receive an information clip and which will strongly discourage and prevent the accidental and/or intentional removal of the clip from the hanger.

It is a further object of the invention to provide such information clips which are readily fabricated by economical processes, such as plastic extraction, and such hangers which are economically fabricated by injection or compression molding.

SUMMARY OF THE INVENTION

According to aspects of the present invention the information clip not only resiliently engages a ledge adjacent the edge of the clip holder, but in addition is provided with means to discourage or prevent moving the clip side walls apart to disengage the clip from the ledge. In certain forms of the invention, further assurance of non-removability is provided by engaging edges of the clip with engagement elements on the clip holder, without interfering with use of conventional molding for producing the hanger. In other forms of the invention, other arrangements are provided to retain the clip on the hanger by strongly inhibiting lifting one or both side walls of the clip by use of fingers or finger nails.

BRIEF DESCRIPTION OF THE DRAWINGS

FIG. 1 is a perspective view of a prior art information clip;

FIG. 2 is a cross-sectional view of the prior art information clip of FIG. 1 as attached to a prior art clip holder forming part of a garment hanger;

FIG. 3 is a perspective view of an information clip in accordance with one embodiment of the present invention;

FIG. 4 is a perspective view of a portion of a garment hanger showing a new clip holder in accordance with the invention adapted to cooperate with the clip of FIG. 3.

FIG. 8 is a fragmentary plan view of a garment hanger showing details of the new clip holder of FIG. 4 securely holding the new information clip of FIG. 3;

FIG. 9A is an illustrative transverse sectional view of a portion of the clip holder of FIG. 4 and the information clip of FIG. 3 shown in a pre-mounting position;

FIG. 9B is an illustrative transverse sectional view of a portion of the clip holder of FIG. 4 with the information clip of FIG. 3 partially mounted to the clip holder, but not yet securely locked;

FIG. 9C is a transverse sectional view of a portion of the clip holder of FIG. 4 and the information clip of FIG. 3 in accordance with the invention, taken along the line 9C—9C of FIG. 8 with the clip fully engaged with the holder;

FIG. 10 is a plan exploded view of a portion of a garment hanger having a new clip holder in accordance with the invention and a prior art information clip;

FIG. 11 is a transverse sectional view of the new clip holder in accordance with the invention taken along the line 11—11 of FIG. 10, with a prior art information clip prior to securement to the clip holder;

FIG. 12 is a transverse sectional view similar to FIG. 11 showing a prior art information clip secured to the new clip holder in accordance with the invention.

FIGS. 20A to 20D show cross-sectional views of another embodiment of a clip and the clip holder portion of a garment hanger, according to the invention, in various stages of mounting the clip upon the holder.

FIG. 21 shows a cross-sectional view of still another embodiment of a clip mounted on the clip holder portion of a garment hanger according to the invention.

FIG. 22A to 22C show cross-sectional views of yet another embodiment of clip and holder according to the invention.

DETAILED DESCRIPTION OF THE PREFERRED EMBODIMENTS

Figure 5:
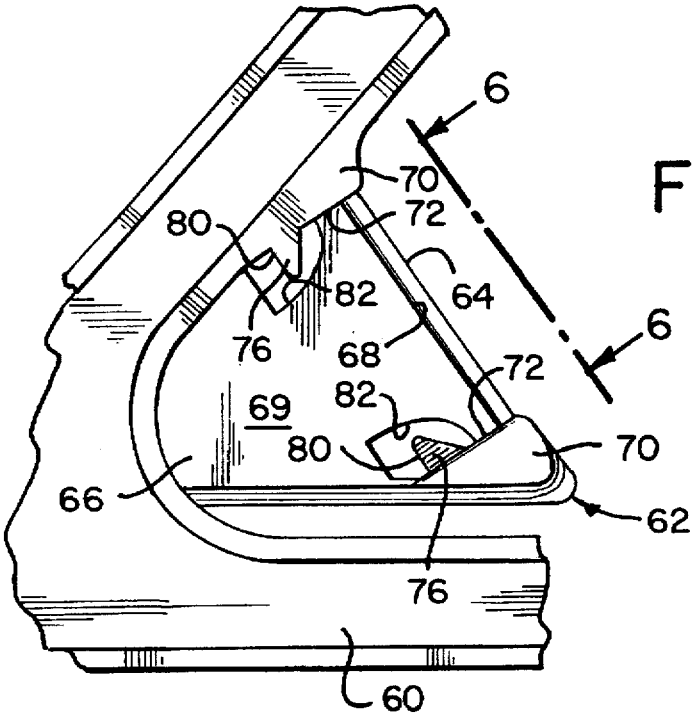
FIG. 5 is a fragmentary plan view of the garment hanger of FIG. 4 showing details of the clip holder.

Referring to FIGS. 1 and 2 of the present drawings (labeled "prior art"), a commercially available and commonly used channel-shaped information clip 10 having a generally U-shaped cross- section is shown, having a front surface 12, integrally formed side walls 14 and 16, and corresponding respective locking fingers 18 and 20. Each side wall 14, 16 defines a lower edge 22, 24, outer surfaces **14*a*, 16*a* and inner surfaces 14*b*, 16*b*, respectively. The locking fingers 18, 20 are located along the inner surface 14*b*, 16*b*, respectively, and run the length of the information clip 10. An insertion opening 25 is defined by the two side walls 14, 16, between their lower edges 22, These prior art information clips 10 are usually manufactured by an extrusion process using a resilient plastic such as PVC or Nylon. The resulting extruded information clip stock is then cut to a desired length (between ¾ and 1 inch) for each clip. Any information indicia, such as the size or price of a particular garment, may be printed on the front surface 12 and/or the outer surfaces 14*a*, 16*a* of the sidewalls 14, 16**, using any conventional lettering transfer or printing technique.

Referring to FIG. 2, the prior art clip holder 30 is shown in cross-section with a mounted prior art information clip 10. The clip holder 30 includes a rounded or tapered securing ridge 32 and a concealing ridge 34. The information clip 10 is held to the clip holder 30 by the engagement of each of the inwardly and upwardly directed locking fingers 18, 20 with a respective shoulder on the securing ridge 32. The side walls 14, 16 are resilient when they are displaced from a relaxed position. The material used and the shape of the information clip 10 allows the side walls to be displaced from each other, against the inherent resiliency of the clip 10.

As the information clip 10 is pushed onto the securing ridge 32 the legs 14, 16 are spread apart by the ridge 32, until the locking fingers 18, 20 contact the securing ridge 32. Further advance of the information clip 10 forces the two side walls 14, 16 further apart, sufficiently to allow the flexible locking fingers 18, 20 to clear the securing ridge 32. Once clear of ridge 32, the locking fingers 18, 20 will spring back to engage the shoulders on the inner side of the securing ridge 32 and the side walls 14, 16 will move back toward their relaxed position as shown in FIGS. 1 and 2. The natural resiliency of the information clip 10 provides a holding engagement with the securing ridge 32.

The information clip 10 may be removed from the securing ridge 32 by pulling the side walls 14, 16 apart with respect to each other (as illustrated by the arrows 26 in FIG. 2), against the inherent resiliency urging them to the relaxed position, sufficiently for one or both of the locking finger 18, 20 to clear its engagement with the securing ridge 32. This prior art structure merely discourages, but does not prevent, the removal of the information clip 10, by somewhat inhibiting access to the lower edges 22, 24 of the side walls 14, 16, by the concealing ridge 34. In doing so, it becomes somewhat difficult, yet not at all impossible, to pull either of the side walls 14, 16 sufficiently apart from the holder to remove the information clip 10 from the clip holder 30 of the prior art.

The present invention provides a much more secure mounting of a clip on a clip holder, resistant to removal. It comprises two interactive parts: a garment hanger with a new clip holder and a new mating information clip. The information clip, in accordance with the invention, is designed to be easily positioned and locked onto the clip holder to provide an arrangement which is not only child-proof (i.e., where a child could not physically remove the information clip once it was secured) but also preventing intentional manual removal of the clip by others.

However, both the present information clip and the present clip holder are versatile. The information clip of the invention may also be used with the prior art clip holder 30 of FIG. 2, and also the present clip holder is shaped to receive prior art information clips 10 (as will be evident from FIGS. 10–12 described below). Because of the limitations of the prior art described above, if a prior art clip holder is used in combination with the clip of the present invention, accidental or intentional separation of the clip from the clip holder will only be discouraged and not prevented.

In accordance with one embodiment of the invention, and referring to FIG. 3, an information clip 40 has a front surface 42, two opposing side walls 44, inwardly directed locking projections 46, an insertion gap 48, and outer locking hooks 50. In the relaxed state of clip 40, its projections 46 are desirably separated by a distance no greater than the thickness of web 66 of the clip holder, so as to enhance the engagement of the projections 46 with the shoulders of ridge 68, as described below. The information clip 40 shown in FIG. 3 differs from the prior art information clip shown in FIGS. 1–2, in that the present information clip 40 includes inner locking projections 46 which are rigid rather than flexible, and have contact surfaces 52 which are substantially parallel to the front surface 42. The present information clip 40 also includes outer locking hooks 50 (having a hook-like cross-sectional shape) each disposed along the lower edge of a side wall 44 and including engagement surfaces 54 that are directed outwardly from each respective side wall 44.

The present information clip 40, like the prior art clip 10, may be manufactured by a conventional extrusion process using an appropriate plastic such as PVC or nylon. The present information clip 40 is preferably made of a material having a natural resiliency so that the side walls 44 may be flexed, or otherwise deformed, but will naturally return elastically to a relaxed position. Alternatively, the walls or legs 44 may be rigid, and all flexing made to occur at the end face 44 or the corners where the legs join the end faces, forming hinge-like structures. The information clips 40 will thus have a "memory", and will (unless unduly stressed beyond an elastic limit be spring-biased back to its relaxed position.

Referring to FIGS. 4 and 10, a portion of a garment hanger 60 having a clip holder 62 formed in accordance with the present invention is illustrated. The clip holder 62 is formed with a central web 66 having an exposed front or leading edge 64. A securing ridge 68 is formed along the exposed edge and has a triangular or other tapered cross-sectional shape with a shoulder on its inner side adapted to selectively engage with an information clip 40 as described above (or with a prior art information clip 10) when the clip is mounted on the clip holder 62.

A receiving area 69 of the clip holder 62 for receiving the information clip 40 is defined by the exposed edge 64 and side bosses 70. Each side boss 70 is preferably formed integrally with the entire garment hanger 60 and includes an inwardly directed side wall surface 72 which faces towards and is parallel to an opposite boss 70. The central web 66 and the securing ridge 68 are formed generally perpendicular to and between the inwardly directed surfaces 72 of the two bosses 70. The thickness of each boss 70, as measured perpendicular to the central web 66, may be the same as the thickness of a reinforcing rib 71 extending around the edge of the hanger, and is preferably substantially equal to the width of the front surface 74 of the information clip Referring to FIGS. 4–7, projecting from and preferably formed integral with the inwardly directed surface 72 of each boss 70 is an engagement element in the form of a tab 76. One tab 76 is formed as a continuation of the upper surface of boss 70, while the opposite tab 76' is formed as a continuation of the lower surface of the opposite boss 70', as seen in FIG. 6.

Figure 6:
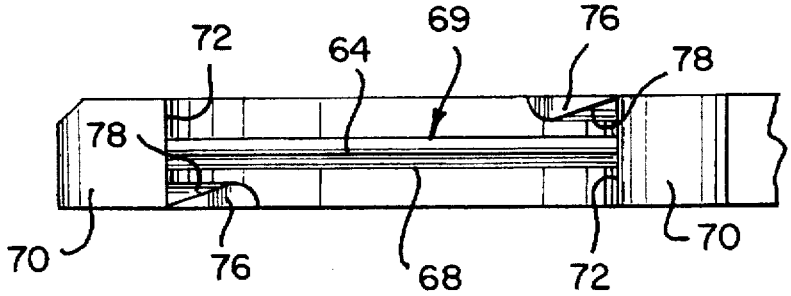
FIG. 6 is a front view of the clip holder of FIG. 4 viewed along the line 6—6 of FIG. 5.
Figure 7:
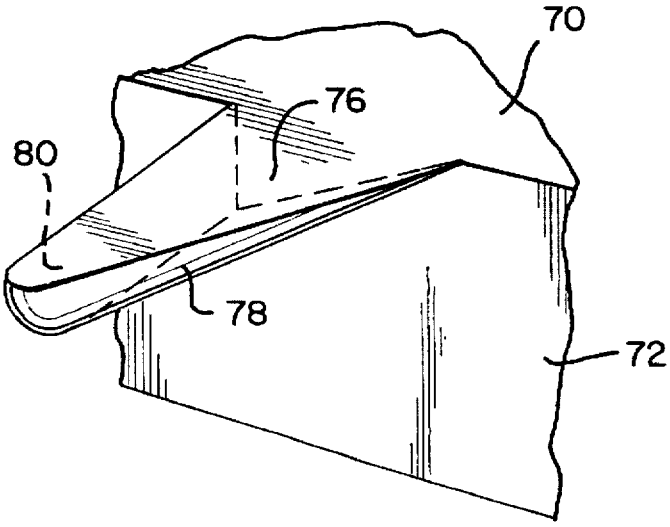
FIG. 7 is an enlarged fragmentary perspective view of a portion of the clip holder of FIG. 6 showing details of an engagement tab.

In this embodiment, only two engagement tabs 76, 76' are used for opposing-side, opposing-end engagement with a mounted information tab 40. Each engagement tab 76 is shaped to easily accept and guide a respective side wall 44 of the information clip 40, as the clip is advanced towards its fully mounted position. This is accomplished by providing a slope or ramp 78 along the forward (towards the leading edge 64) side of each engagement tab 76. This slope is directed outwardly away from the central web 66 towards the leading edge 64, as shown in FIGS. 6–7. Each engagement tab 76, 76' further includes a rear engagement surface 80 which preferably lies in a plane which is substantially perpendicular to both the adjacent inwardly directed surface 72 of the boss 70 and the central web 66. The forward-facing ramp 78 is shaped rounded to provide a smooth transition to the rear engagement surface 80 or may be a planar slanted surface.

As mentioned above, only two diagonally opposing engagement tabs are used with the tab holder 62. Due to the relatively short length of the information clip 40 (or the prior art clips 10), it is only necessary to secure or hold down a small portion of each side wall 44 (at either end) of the information clip 40 to ensure that the information clip 40 is effectively non-removable. In this embodiment, the engagement tabs 76 function to directly hold the information clip 40 to the tab holder 62, as well as indirectly. Not only do the tabs 76 prevent outward movement of the clip by engaging the hook extensions 50 of the clip, but by preventing the separation of the side walls 44 of the clip 40 by the tabs 76, the inner locking projections 46 of the clip are caused to remain engaged with the securing ridge 68 of the tab holder 62 so that the information clip 40 will not be removable from the garment hanger 60. Therefore, the information clip 40 is directly secured to the garment hanger 60 by the strong engagement between the inner locking projections 46 and the securing ridge 68, providing more than the slight hold down strength required to prevent the side walls 44 of the information clip 40 from being separated. The hook-like engagement between the rear engagement surfaces 80 and the outer locking hooks 50 provides further removal prevention of the information clip 40.

As shown in FIGS. 4 and 5, an opening 82 is provided in the central web 66 adjacent each engagement tab 76. The purpose of each opening 82 is to provide plastic injection molding access to the underside of each engagement tab 76 which would otherwise be hidden or "shadowed" by the central web 66, avoiding undercuts so that the molding process can be inexpensive and rapid. If the openings 82 where not provided, to manufacture the engagement tabs 76 the resulting mold would have to include a movable insert feature which slows production down and introduces undesirable complexity. With the openings 82 present, the entire garment hanger with the clip holder 62 shown in FIGS. 4–7 can be made using a simple generally planar plastic injection mold.

Referring to FIGS. 8 and 9A–9C, the operation of securing an information clip 40 to a clip holder 62 in accordance with the invention is shown. In each of the FIGS. 9A–9C, a partial cross-sectional view of the present clip holder 62 is represented with a cross-sectional view of the clip 40 taken along the line 9C—9C of FIG. 8. For assembly, an information clip 40 is first properly oriented and its gap is pushed against the exposed leading edge 64 of the clip holder 62 so that the clip legs 44 are separated to allow the central web 66, the exposed edge 64 and the securing ridge 68 of the clip holder to enter within the insertion gap 48 of the information clip 40. The outer surface of the securing ridge 68 is formed to facilitate this insertion. In the present embodiment of this invention, the depth 84 of the securing ridge 68 (see FIG. 9A) is less than or equal to the distance 86 between the contact surfaces 52 and the inner surface 88 of the clip front wall 42 within the channel 48. Further, the distance 90 between the rear engagement surface 80 of tab 76 and the rearmost portion of the securing ridge 68 of the clip holder 62 is less than or substantially equal to the distance 92 between the contact surface 52 of projections 46 and the outer locking hooks 50 of the information clip 40. The inward extent 94 of the engagement tabs 76 is preferably sufficiently shallow to allow easy travel of an outer locking hook 50 of an advancing information clip 40 between the central web 66 and the engagement tab 76.

Referring now to FIG. 9B, as the information clip 40 is further advanced on the clip holder 62, each outer locking hook 50 is directed inwardly towards the central web 66, against the natural spring bias of the clip 40, by the forward facing ramp 78 of each respective engagement tab 76 until the state shown in FIG. 9B is attained. Simultaneously, the inner locking projections 46 contact the securing ridge 68 which tends to force the side walls 44 apart at the location of the contact surfaces 52. The result is that each respective side wall 44 of an advancing information clip 40 is being forced outward adjacent its middle and simultaneously drawn inward along its lower edge. The degree of this side wall contortion is controlled by properly dimensioning the location, size and shape of the engagement tabs 76, the inner locking projections 46, the outer locking hooks 50 and the securing ridge 68. With such proper dimensioning, the information clip 40 will require little force to fully mount to the clip holder 62, but will require a great force (comparable to tearing the material) to remove.

Eventually, as shown in FIG. 9C, the outer locking hooks 50 engage with the engagement tabs 76, preferably at about the same time that the inner locking projections 46 snap into locking engagement about the securing ridge 68. When the information clip 40 reaches its fully mounted position, as shown in FIG. 9C, the side walls 44 are preferably allowed to displace partially back toward their relaxed positions. The side walls may remain forced slightly inwardly towards the central web 66 so that the natural spring bias inherent in the information clip 40 retains each outer locking hook 50 in tight engagement with the engagement tabs 76.

The engagement tabs 76 shown and described thus far represent a preferred embodiment taking into account the desirability of a simplified mold. The engagement tabs 76 may take any shape, including extending completely across the receiving area 69 to connect the bosses 70 together. The engagement tabs 76 do not have to include the rear engagement surface 80. Instead, a second rear ramp (not shown) may be provided on each engagement tab 76 which contacts and holds down a respective side wall 44 of the information clip 40, yet does not strongly engage the outer locking hooks 50. In this case the inward pressure exerted on the edges 50 of the sidewalls by the tab ramps serves to retain the projections 46 in engagement with the shoulders 68, permitting the information clip 40 to be more easily forced off the clip holder 62 when using this type of engagement tab 76. A similar contemplated embodiment (not shown) where the information clip 40 may be removed with some difficulty (by an adult) includes forming the securing ridge 68 with portions cut away at opposite ends of ridge 68 so that the mounted information clip 40 may be twisted from its engagement with both the engagement tabs 80 and the securing ridge 68. In this embodiment the securing ridge 68 includes non-engaging portions at either end of the exposed edge 64 and on the side opposite where the adjacent engagement tab 76 resides.

Referring now to FIGS. 10–12, the garment hanger 60, in accordance with the invention, as described above and as shown in FIGS. 4 to 7, is shown accepting a prior art clip 10, like the one shown in FIGS. 1–2. This engagement will lock the prior art information clip to the garment clip holder, but with somewhat less strength than when using the information clip of the present invention. Like the above-described embodiment of the invention, at least one (and preferably both) side walls 14, 16 of the prior art information clip 10 are physically prevented by the tabs 76 from being drawn apart, once the clip is engaged with the securing ridge 68, so that the prior art information clip 10 cannot be readily removed from the clip holder 62.

FIG. 11 shows a clip holder 62, in accordance with the invention, adjacent to and in a position about to receive a prior art information clip 10 without the outer locking hooks 50. FIG. 12 shows the clip holder 62, in accordance with the invention, having a prior art clip 10 mounted thereon. The forward facing ramp 78 of each engagement tab 76 forces a respective side wall 14 or 16 inwardly towards the central web 66, so that the locking fingers 18, 20 maintain a locking engagement with the securing ridge 68, and the prior art clip 10 becomes nearly irremovable from the present garment hanger 60.

Figure 13:
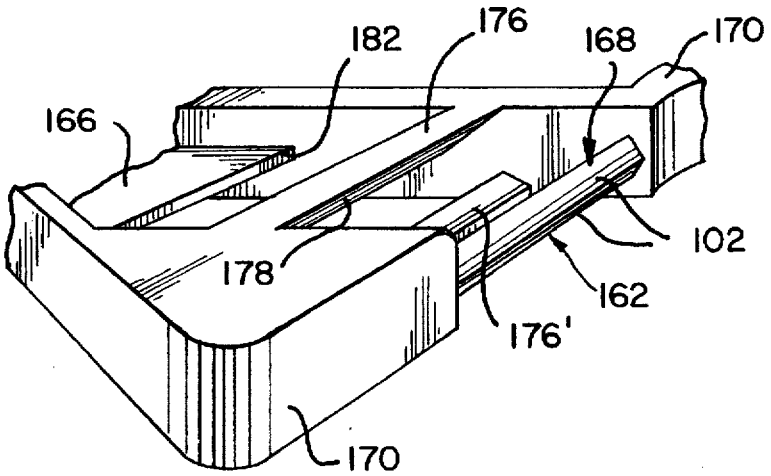
FIG. 13 is an isometric view of the clip holder portion of a garment hanger incorporating a modified form of the present invention.
Figure 14:
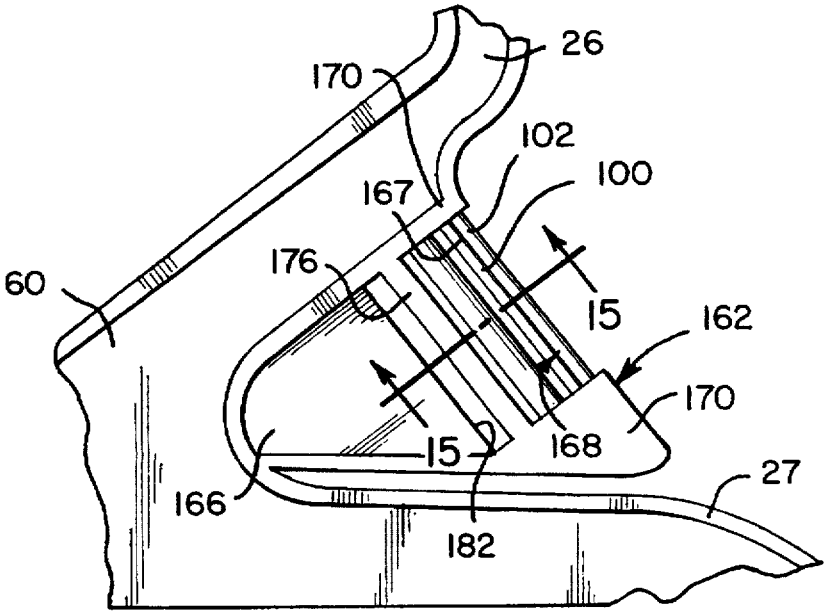
FIG. 14 is a plan view of a portion of a garment hanger showing the hanger clip holder of FIG. 13.
Figure 15:
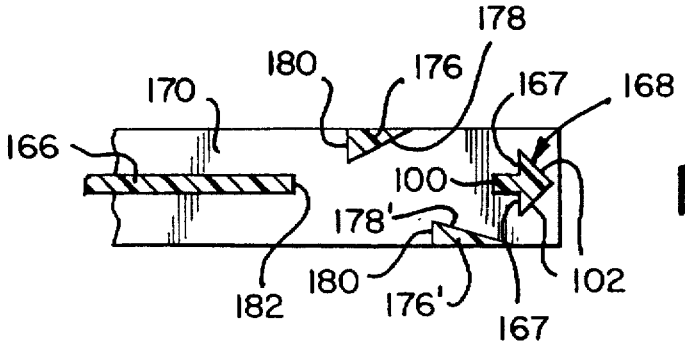
FIG. 15 is a cross-sectional view of the clip holder of FIG. 14 viewed along line 15—15 therein.

While extension tabs 76, 76' may extend a relatively short distance from one boss 70 toward the other, in order to afford a greater engagement region for the clip when installed, and for greater strength of retention, the arrangement shown in FIGS. 13–15 may be used, having extension elements 176, 176' extending across the entire distance between the bosses 70.

As seen in FIGS. 13 and 14, the web 166 of clip holder 162 is provided with an opening 182 between the inner portion of web 166 and a cross-piece 100 which extends between the bosses 70 and has a securing ridge 168 at its outside edge. Ridge 168 is here shown as having slanted flat forward faces 102, but may be made with a suitably rounded edge as in the case of FIG. 9B. As before, securing ridge 168 has a shoulder 167 on each side of web 166 for engaging a respective inner locking projection 46 of the clip.

From one view point the opening 182 is an enlargement of and connects the openings 82 shown in FIG. 5. Similarly, the engagement tab 76 of FIG. 5 is in FIG. 13 in effect extended across the entire width of the web 166 (i.e., distance between bosses 170) to form an extended engagement element in the form of a cross-piece 176 having a sloped surface or ramp 178 for guiding the respective side wall of the clip toward the surface of web 166. The second engagement tab 176' is similarly extended across the entire width of the opening 182 as an engagement element in the form of a cross-piece. Cross-piece 176' may be directly beneath cross-piece 176, if desired, but preferably it is offset so that the two cross-pieces 176 and 176' have differing distances from the exposed edge 164 of the clip holder 162, and do not shadow one another, to facilitate injection molding without requiring special movable inserts for the molds.

The cross-piece engagement elements 176 and 176' have flat interior surfaces 180, 180' which engage the locking hooks 50 of the information clip in the manner illustrated in FIG. 9C. Thus, this form of clip holder of FIGS. 13–15 functions with the clip of the present invention or with conventional clips in the same manner as described above with respect to FIGS. 1–12.

Although the slanted ramps 178 and 178' are shown as extending completely across the opening 182, it will be understood that they may be provided for only part of the length of the cross-pieces 176 and 176', and may extend across respectively separate portions of the width of opening 182.

As in the case of the clip holder of FIGS. 3–12, the hooks 50 engaging the flat surfaces 180 reinforce the retention effect of projections 46 engaging the shoulders 67 or 167. As will be seen from FIG. 9C, an effort to release the clip by squeezing together the outer hook members 50 to clear the shoulders 80 or 180 of the projections 76 or 176 only serves to engage the inner projections 46 more strongly against the shoulders of the securing ridge 68 or 168. Hence, the present invention provides a strong locking of clip to clip holder.

Thus, according to the present invention, either a conventional information clip (as in FIG. 1) or a clip according to the invention (as in FIG. 3) is securely retained on the clip holder of the invention, by providing means (e.g. tabs 76, 76' or cross-pieces 176, 176') which prevent the legs of the clip from separating, and thereby keep the projections such as 46 of the clip engaged with the shoulder of ridge 68 or 168 of the clip holder, thus preventing removal of the clip from the clip holder.

In addition, the clip is made additionally nonremovable by providing the hook-like projection 50 on the clip legs which engage the surface 80 of the tabs 76, 76' or surfaces 180, 180' elements 176, 176', to prevent movement of the clip off the clip holder.

Figure 16:
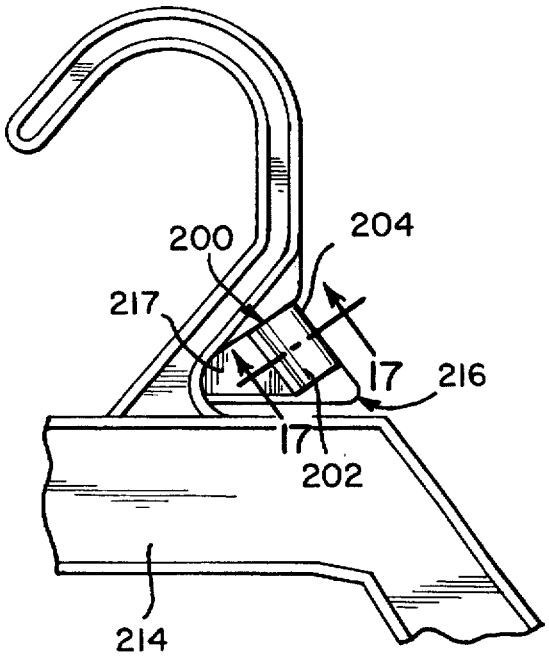
FIG. 16 is a plan view of a portion of a garment hanger having a clip holder with a clip in a locked position, in accordance with another embodiment of the invention.
Figure 17:
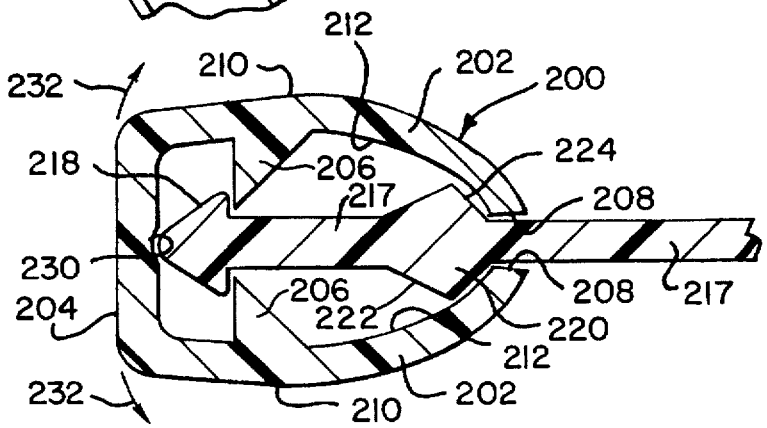
FIG. 17 is a partial cross-sectional view of a hanger clip holder and a clip in the locked position, in accordance with the invention, taken along lines 17—17 of FIG. 16.

Referring to FIGS. 16–17, another embodiment of an information clip 200 and clip holder 216 is shown, viewed in cross-section taken along the line 17—17 of FIG. 16. The clip 200 includes two side walls 202, a front wall 204 and inwardly directed projections 206. Each of the side walls 202 includes a leading edge 208, an outer surface 210 and an inner surface 212.

A hanger 214 shown in FIG. 16, like the previously described embodiments (such as FIG. 10) includes a clip holder 216 formed on a central web 217. As shown in FIG. 17, the clip holder 216 includes a front locking ridge 218. The cross-sectional shape of the front locking ridge 218 which is preferably a truncated triangular shape as shown in FIG. 17, or other tapered shape. The clip holder 216 also includes a rear locking ridge 220 which is spaced inward from the front locking ridge 218. The two side walls 202 of the clip 200 are shaped to embrace the rear locking ridge 220. The cross-sectional shape of the rear locking ridge 220 is preferably roughly diamond-shaped, as shown in FIG. 17; however, a rounded diamond shape or a circular shape (among other shapes) may be used. The rear locking ridge 220 includes a forward sloping side 222 and a rear sloping side 224. The forward side 222 is shaped to function as a receiving ramp for allowing the leading edges 208 of the clip 200 to easily slide into the locked position on the clip holder 216, as described below. The rear side 224 of the rear locking ridge 200 is preferably slanted toward web 217 and away from and to the rear of the rear locking ridge 220. The cross-sectional shape of the rear side 224 preferably matches the shape of the side walls 202, as discussed below. The purpose of the rear side 224 of the rear locking ridge 220 is to help maintain engagement between the side walls 202 of the clip 200 and the clip holder 216. The matching shapes between the rear side 224 of the rear locking ridge 220 and the side walls 202 discourages the lifting of either leading edge 208 of the clip 200 from the rear side 224 by supporting the side walls 202 of the clip 200. This close contact of the side walls 202 and the rear side 224 inhibits any bending of the side walls 202 towards the front locking ridge 218 and thereby helps to maintain engagement between the clip holder 216 and the clip 200.

The side walls 202 of the clip 200 of this embodiment, as shown in FIG. 17, are preferably curved towards each other, at their leading edges 208. The clip 200 is sized and shaped to allow the curved side walls 202 to reach just beyond the rear side 224 of the rear locking ridge 220 when the clip 200 is pushed fully onto the clip holder 216 and reaches its locked position, as shown in FIG. 17. When the clip 200 is in its locked position on the clip holder 216, the inwardly directed projections 206 engage with the front locking ridge 218 and lock the clip onto the clip holder 216.

When the clip 200 reaches its fully locked position, as shown in FIG. 17, the leading edges 208 preferably close together under the spring bias of the clip itself and contact flush with the central web 217. The leading edges 208 may also include a beveled edge (to lie flush against the central web 217) to further discourage the lifting of the side walls 202 and the removal of the clip 200.

Figure 18:
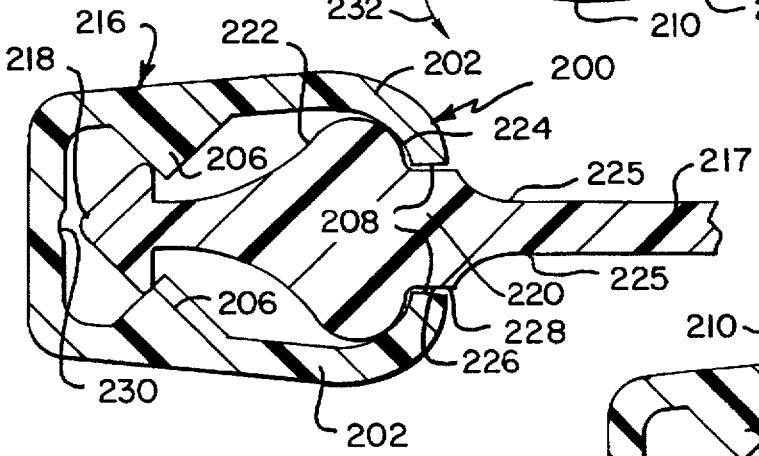
FIG. 18 is a cross-sectional view of a clip and the clip holder portion of a garment hanger in accordance with still another embodiment of the invention.
Figure 19:
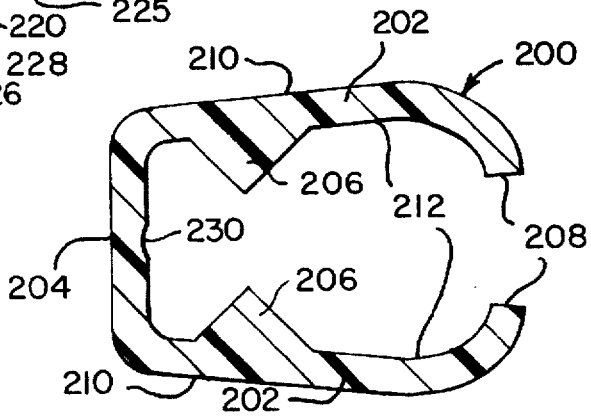
FIG. 19 is a side view of the information clip of FIG. 18 shown without the clip holder.

In accordance with another embodiment of the invention, and referring to FIGS. 18 and 19, the front locking ridge 218' is made thinner than the rear locking ridge 220' (the thickness of either ridge being measured perpendicular to the central web 217). The rear ridge 220' is made with a rounded outward slope 222' and inward slope 224'. By making the front ridge 218' thinner than the rear ridge 220', the clip 200 may be more easily pushed onto the clip holder 216'.

As the clip 200' is pushed onto the holder, its edges 208' engage front slope 222' of rear ridges 220', and are separated sufficiently to allow the front ridge 218' to pass between the inwardly extending projections 206', until the clip edges 208' pass onto the rear slope of rear ridge 220', whereupon the edges 208' resiliently return toward their unstressed position so that the projections 206' engage the shoulders of front ridge 218' and concurrently the clip edges 208' engage behind rear ridge 220'.

Along the rear side 224' of the rear ridge 220' may be provided a plateau or step 226, positioned to receive the leading edges 208' of the clip 200' when the clip is pushed into its fully locked position, as shown in FIG. 17. The width of the plateau 226 (measured axially parallel to the central web 217) is preferably slightly greater than the thickness of the leading edges 208' of the side walls 202' so that a small portion 228 of the plateau 226 remains uncovered by the leading edges 208 when the clip 200 is in its locked position. Alternatively, the plateau may have a width equal to (but preferably not less than) the thickness of the clip legs, so that the legs do not extend beyond the plateau. When the clip is in its locked position, its leading edges are thus made relatively inaccessible to a person's fingernail and may be pried apart only with difficulty. Each of the plateaus 226 merges into the web 217' by a curved surface 225. Thus, if manual removal is attempted, as the fingernail slides along the central web 217, in a forward direction, and rides up the surface 225 to the plateau 226, the fingernail will jump over the otherwise accessible leading clip edge and continue along the outer surface of the side wall 202' of the clip 200', failing to engage the leading edge 208'. The harder the person slides his fingernail across the web 217, the more pronounced the jump action and the more difficult the clip becomes to remove.

The clip 300 shown in FIG. 19 is made with its side walls 302 spread further apart in the unstressed condition. This clip will cooperate with the holder of FIGS. 17 or 18. The distance between the leading edges 308 of the side walls 310, 312 is made greater than the thickness of the front locking ridge 318 so that the clip 300 may be freely pushed onto any of the forms of clip holder past its front ridge. At this point the clip may easily be forced into the locked position by pushing its leading edges 308 up over the wider holder rear ridge, such as 220.

While the separation between the clip leading edges of FIG. 18 or 19 is made greater than the width of the ridge of the holder leading edge 218' of FIG. 18, during further insertion the legs will be made to separate enough for the holder leading ridge to pass between projections 206', which on further insertion will then lock behind the holder outer ridge 218', while at the same time the clip legs provide further holding action by engaging behind the holder inner ridge 220'. This arrangement requires less insertion force than the previously described forms.

While in FIGS. 17–19, the projections 206, 206', and 306 are shown as truncated triangles in cross-section, they may alternatively be square in section, with their surfaces engaging the holder leading ridge flatly and substantially perpendicular to the clip legs. FIGS. 20A to 20D show such a configuration, where FIG. 20A shows the clip and holder before insertion, FIG. 20B shows the clip as it first engages the holder, FIG. 20C shows the clip partially engaged, and FIG. 20D shows the clip fully engaged. As in the other forms, the cross-sections of the clip and holder are bilaterally symmetrical so that only one side need be described, the other side being a mirror image thereof.

In this form, the clip 400 has legs 410 which are preferably rigid, joined at their front (outward) ends by front wall 404 which is resiliently flexible (as by a groove or reduced thickness at 430) or hinged at the corners. The clip is provided with a channel 401 having ledges 407 on the inner side formed by rigid inwardly extending projections 406. Each leg 410 terminates in an edge 408 having a flat tip 426. The holder is formed on the outward portion of web 417, and has a locking ridge 446 at its leading edge. Ridge 446 may have a front face which is flat or of any convenient shape. It is formed with shoulders 452 on its inward sides. Each shoulder 452 and ledge 407 is substantially perpendicular to the web 417 and the leg 410 The holder has an enlargement 420 with a slope 422 spaced inward from the projections 446 by flat areas 447 at least co-extensive with projections 406. The enlargement 420 has a flat shoulder 427 inward of the slope 482, which is essentially perpendicular to web 417. A step 428 is formed inward of the shoulders 427, and merges into the web 417 by a curved section 425. The separation between leg ends 428 when relaxed is larger than the width of holder ridge 418 so that on application of the clip to the holder, the clip passes freely past the holder ridge 418 until the clip legs 428 contact the slopes 422, as seen in FIG. 20B. Further insertion of the clip causes the legs to spread, until as shown in FIG. 20C, the separation of the projections 406 exceeds the width of outer ridge 418. Further insertion of the clip allows the ridge 418 to enter the channel 401. Concurrently the resilience of the clip end wall 404 clamps the legs 410 around the enlargement 420, with the leg edges 426 resting on the steps 428, as described with respect to FIG. 18. In this instance, the legs 410 have perpendicular edges 411 which engage the shoulders 427, thereby restraining the clip on the holder both by engagement of ledges 407 with shoulders 452, and by engagement of leg surface 411 with shoulders 427. At the same time, access for removal is strongly inhibited by the steps 428 and curved section 425. FIG. 20D shows the final engagement of the clip and holder.

FIG. 21 shows an alternative assembled clip 502 and holder 504. In this case, the holder enlargement 220 or 220' or 420 is omitted and the holder made uniform over most of its length 506 as seen at 507. Similarly the clip has former projections 206, 406 extended for the length 506, with a ledge 510 near its rear ends as seen at 520. The clip leading edge 508 has a cooperating shoulder 512. The holder outer ridge 514 is shown as triangular in shape, but may have any shape with sloping sides 516 which upon insertion of the clip will spread clip legs 518 sufficiently so that the clip projections 520 will pass over the holder projections 522 until the ledge 510 engages the shoulder 512 to retain the clip on the holder. The clip leg ends 526 engage the holder steps 528 and ends of projections 507 as in FIG. 20A. Reduced thickness of the legs 518 as at 523 provides a resilient hinging action for rigid legs 518 with respect to top wall 502.

Figure 22C:
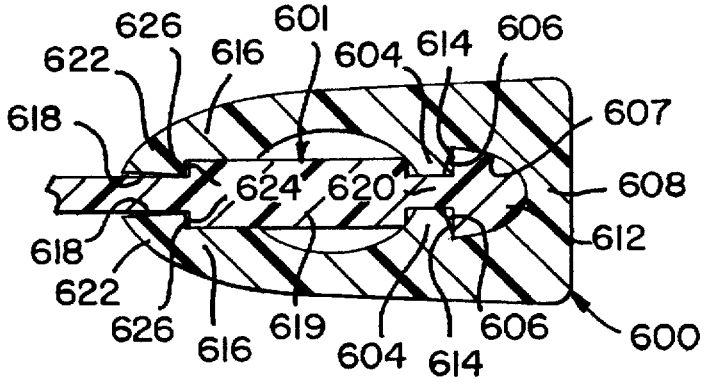

FIGS. 22A to 22C show still another form of clip 600 and holder 601, in disassembled state in FIG. 22A, in partially assembled state in FIG. 22B, and assembled in FIG. 22C. In this case, the clip 600 has two inwardly directed projections 604 with perpendicular ledges 606, defining a channel 607 with end wall 608. The clip holder 601 has a tapered or rounded leading edge 612, with a shoulder 614 on one side of a groove 620. Shoulders 614 engage ledges 606 when assembled, as seen in FIG. 22C. The clip legs 616 curve inwardly and terminate in flat surfaces 618 which have an axial length greater than the width of grooves 620, so that the clip ends 622 do not enter the grooves 620. Those ends 622 have shoulders 624. The clip holder has a uniform thickness section 619 extending inward of grooves 620, ending in a shoulder 626 which engages the clip shoulder 624 when the clip is fully inserted, as seen in FIG. 22C. An arrangement corresponding to step 208 or 208' of FIG. 18 or FIG. 20 may be used here if desired. Here the unstressed clip leg separation is made smaller than the thickness of holder web 628 or a step (if used). On insertion, the tapered leading edge 612 of the holder separates the clip legs 616 which then ride on the holder section 619 until the clip leg ends 622 engage the holder shoulders 626. Concurrently the clip inward projections 604 engage the grooves 620 so that the clip is held on the holder both by its ends 622 and its projections 604.

Figure 23A:
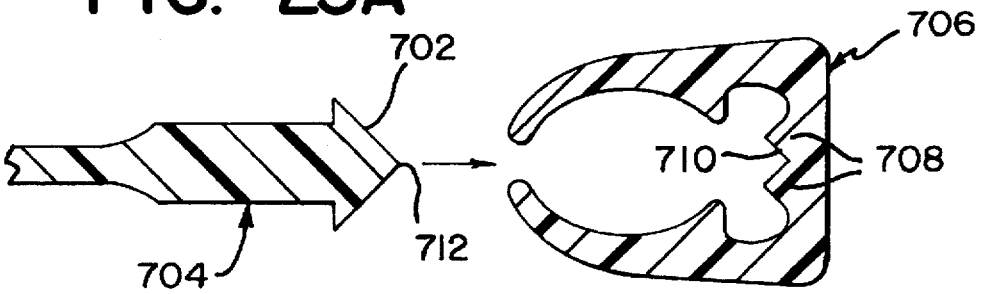
FIG. 23A and 23B show cross-sectional views of another form of clip and clip holder according to the invention, in unmounted and mounted condition.
Figure 23B:
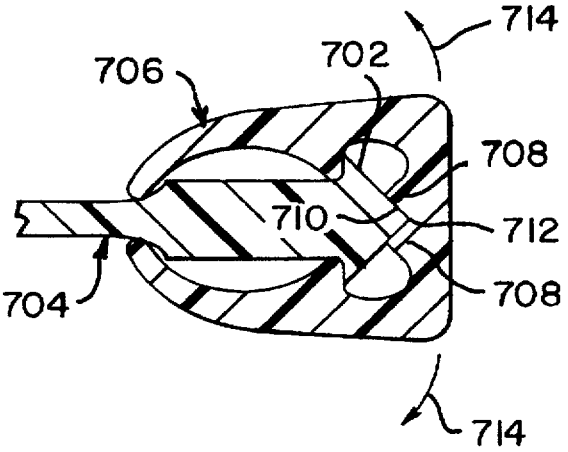

FIGS. 23A and 23B show a feature which may be used with any of the forms described above which have a tapered leading free edge 702 on the clip holder 704. Here the inner face of the clip 706 is formed with a pair of bumps 708 forming a groove 710 to accommodate the tip 712 of the tapered holder ridge 702. This inhibits twisting the clip sideways, in the direction shown by arrows 714, if an attempt is made to remove the clip from the holder, and increases the difficulty of removal of the clip.

While holder front ridge 68 or 168 or 218 or 218' or 418 or 516 or 612 or 712 is preferably at the outer free edge of the holder, it may be spaced slightly from that free edge by a web portion where desired.

In the forms shown in FIGS. 16 to 23, the inwardly directed projections such as illustrated by 206 of the clip are preferably rigid and non-resilient and do not themselves flex during the clip insertion process. As the clip 200 is pushed onto the clip holder 216, the larger dimensions of the locking ridges (218 and 220) will force the inwardly directed projections 206 apart, with their respective side walls 202. The clip 200 in accordance with these embodiments of the invention may also include a weakened point along the forward face 204 of the clip 200 to function as a live hinge enabling the side walls 202 to flex apart. This live hinge may be created by a longitudinal groove 230 on the end wall of the clip or by the relative thickness between the front face 204 and the side walls 202 of the clip 200, or by other known methods.

It is also contemplated that the inwardly directed projections 206, 206' be sized and shaped to prevent any twisting movement (as in the direction of arrows 232 in FIG. 18) by the clip 200 for removal when in its locked position. It is this twisting movement which might allow the leading edge of the prior art clip to be excessively separated from the prior art clip holder and thereby easily grasped and removed.

Figure 24A:
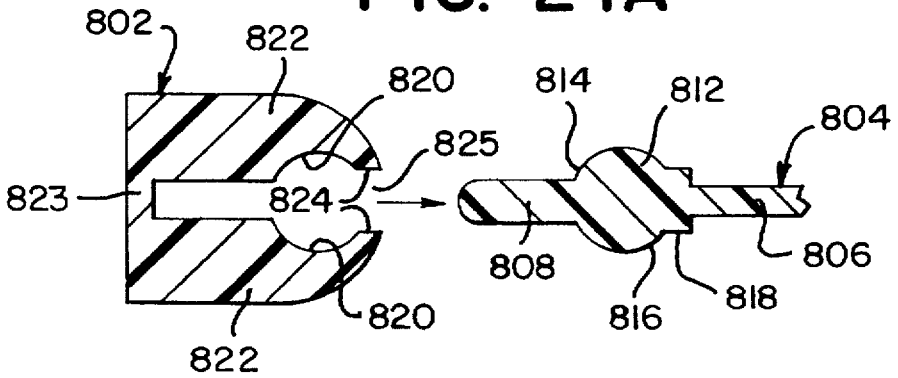
FIGS. 24A to 24D show cross-sectional views of the clip and clip holder portion of a garment hanger in yet another form of the invention, in various stages of assembly.

The forms of the invention described above have relied at least in part upon a tapered or rectangular ridge at the open or leading edge of the clip holder to retain the clip on the holder. FIGS. 24A to 24D show a modification with a different form of retention at the holder leading edge. FIG. 24A shows the clip 802 and holder 804 in disassembled state. Holder 804 forms the outward extension of a web 806, preferably extending from the hook of a garment hanger, generally as shown in FIGS. 5, 8 or 10. Holder 804 is formed with a rigid flat outer extension 808, of a uniform thickness equal to or larger than that of web 806. The axial length of extension 808 may have any suitable value, preferably at least equal to the axial length of the remainder of the holder up to web 806. Inward of extension 808 is an enlargement 812 having a sloping or rounded outer face 814 and a sloping or rounded inner face 816 ending in a step 818 of thickness larger than that of web 806.

Clip 802 has legs 822 joined by a flat resilient end wall 823. The leg edges 820 are separated in their unstressed condition by a spacing 825 greater than the thickness of extension 808, so that the extension 808 may freely enter between the clip legs 822. In addition, each clip leg 822 has a recess 820 inward of the gap 825 between the legs 822 shaped to accommodate the holder enlargement 812. Further inward from the recess 820 is a central channel 824 at least as long as the holder extension 808, and of a width accommodating the extension 808 snugly or with small tolerances.

Figure 24B:
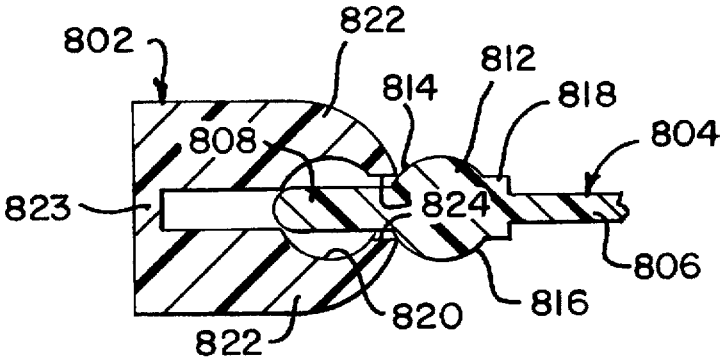
Figure 24C:
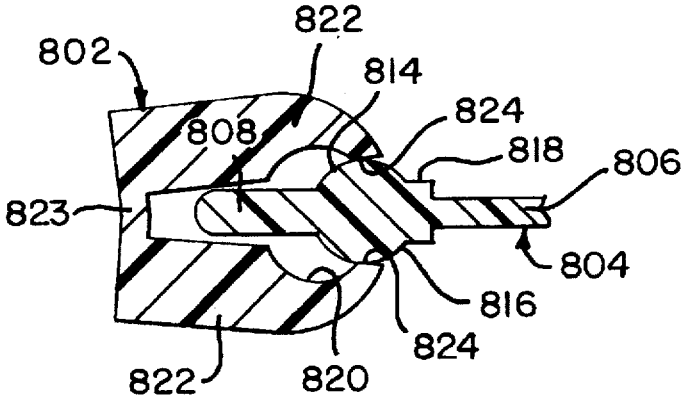
Figure 24D:
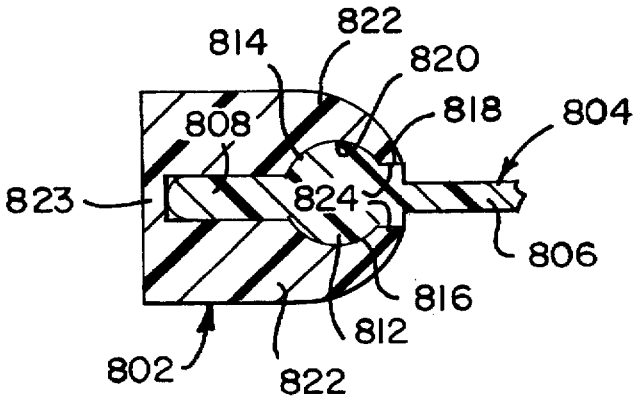
Figure 25:
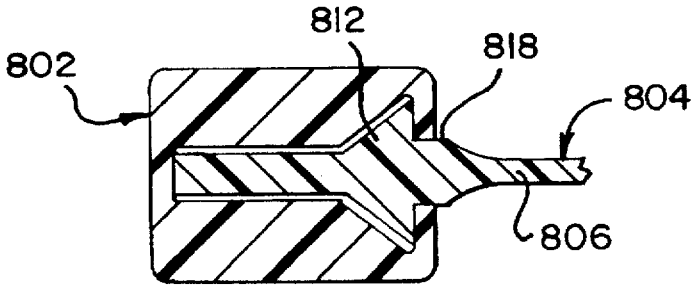
FIG. 25 shows a cross-sectional view of a modification of FIG. 24 according to the invention, with a clip mounted on its holder.

In applying this clip to its holder, the legs 822 first pass freely over the holder extension 808 until the legs 822 engage the leading slope 814 of holder enlargement 812, as seen in FIG. 24B. On further insertion of the clip, the channel 824 slides over the holder extension 808 and concurrently the slope 814 forces the legs 822 apart against the resilient force of end wall 823, as seen in FIG. 20C. This also opens the channel 824 to more readily accommodate the holder extension 808. After the legs 822 pass the widest part of enlargement 812, they resiliently close so that their edges 824 will rest on step 818, in the manner shown in FIG. 24D and FIG. 18. The enlargement 812 may be formed with a shoulder perpendicular to the web 806 (as seen in FIG. 20A) and the ends 824 of legs 822 may extend perpendicular to the web 80C to better engage the clip ends behind enlargement 812. Thus the enlargement 812 may have a generally triangular shape as seen in FIG. 25, corresponding generally to FIG. 24D.

The step 818 may also be provided with a section merging into web 806, like 425 of FIG. 20A or 807 of 25.

The closing of legs 822 behind enlargement 812 serves partially to retain the clip against removal and steps 818 prevent interposing a finger nail under leg 822 for removal. Moreover, even if one leg end 825 could be lifted from its step 818, in an effort to twist off the clip from the holder, any removal would be strongly prevented by consequent engagement of the wall of clip channel 824 with holder extension 808. In addition, any removal attempted by grasping the clip between thumb and forefinger for retraction merely serves to engage the walls of clip channel 824 more tightly with holder extension 808, which creates a frictional engagement between them, resisting removal. If desired extension 808 may be molded with a roughened surface to increase this friction effect.

Figure 26A:
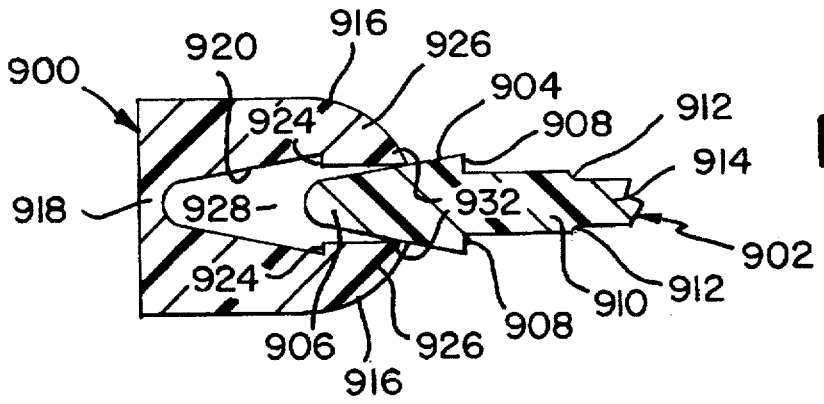
FIGS. 26A to 26C show cross-sectional views of yet another form of clip and clip holder portion of a garment hanger according to the invention, in various stages of mounting the clip on the holder.
Figure 26B:
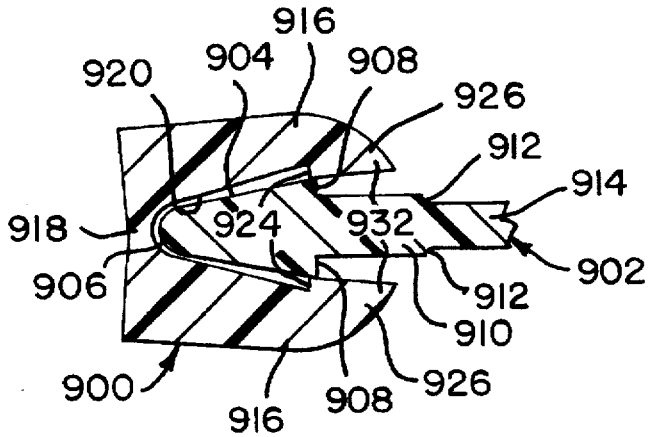
Figure 26C:
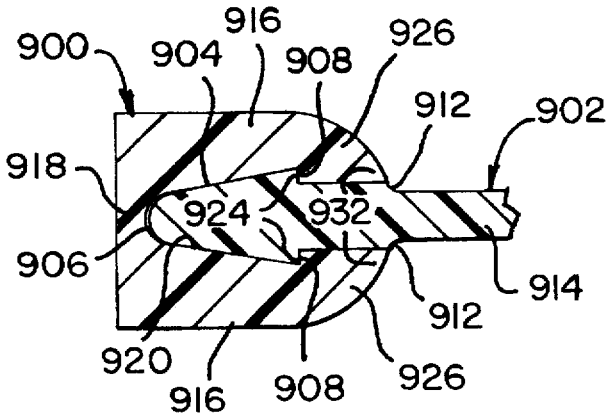

FIGS. 26A to 26C show another form of the present invention, generally similar to FIG. 21, but with different proportions. A clip 900 is assembled on a clip holder portion 902 of a garment hanger. Holder 902 has a tapered outward region 904 ending in a narrow tip 906 which is preferably slightly rounded, but may be pointed. The inward end of tapered region 904 has a pair of shoulders 908, which lead to a uniform thickness region 910. Shoulders 908 extend substantially perpendicular to the plane of the holder 902. Region 910 then leads inwardly, by a smoothly curved region 912, to the web 914, which is preferably joined to the hanger hook in the same manner as web 66 in FIGS. 4, 5 and 8.

The clip 900 is formed as a short section of a plastic extrusion, adapted to extend over at least part of the distance between bosses 70 shown in FIG. 5 or between hanger rims 26 and 27 shown in FIG. 14. In cross section as seen in FIG. 26A, clip 900 has a pair of sidewalls or legs 916 joined by a flat top wall 918. Legs 916 are preferably dimensioned to be essentially rigid, while topwall 918 has a thickness at its center (in the plane of web 914) which permits elastic and resilient bending, so that legs 916 may be spread apart, but are urged toward one another toward their unstressed state by the resilience of the top wall. The clip has a tapered channel 920 conforming closely to the tapered outward holder region 904. Channel 920 ends in a pair of ledges 924 which clip behind shoulder 908.

In the unstressed or relaxed condition of the clip, as shown in the exploded view of FIG. 26A, the ends 926 of the clip legs are separated by a spacing larger than the width 928 of the holder tip, but smaller than the maximum width of the holder outer region 904, so that the clip may be readily inserted to straddle over the holder tip, and the clip leg ends will engage the sloping sides of the holder tapered region 924 as the clip is moved inward of the holder. In the relaxed state, the clip leg ends are spaced apart a distance less than the thickness of the step region 910, so that as the clip ends move beyond holder shoulders 908, the resilience of the clip top wall will elastically urge the clip ends 926 against the step 910, causing the clip ledges 924 to engage behind the holder shoulders 908, to retain the clip on its holder.

The tips 932 of the clip ends 926 are preferably dimensioned to extend just to but not beyond the inward edge 919 of step 910. In this way, any attempt to remove the clip by lifting one edge, as by a finger nail, will result in the finger nail sliding along the curved region 912 onto the outer surface of the clip leg 916, and removal is discouraged or prevented.

As seen in FIG. 26A, the channel 920 between legs 916 has a tapered shape which conforms to the holder tapered section 904 when the clip is mounted. As a further deterrent to clip removal, both the inner surface of clip channel 920 and the outer surface of holder tapered region 904 may be formed of roughened surfaces, as by fine closely spaced serrations or corrugations. In this way, any effort to remove the clip by gripping it between the thumb and finger is resisted by the increased friction between these roughened surfaces caused by the pressure of gripping the clip. Hence the non-removability provided by the latching action of shoulders 908 and the ledges 924 is increased by the roughened tapered surfaces of the clip and the holder.

Figure 27A:
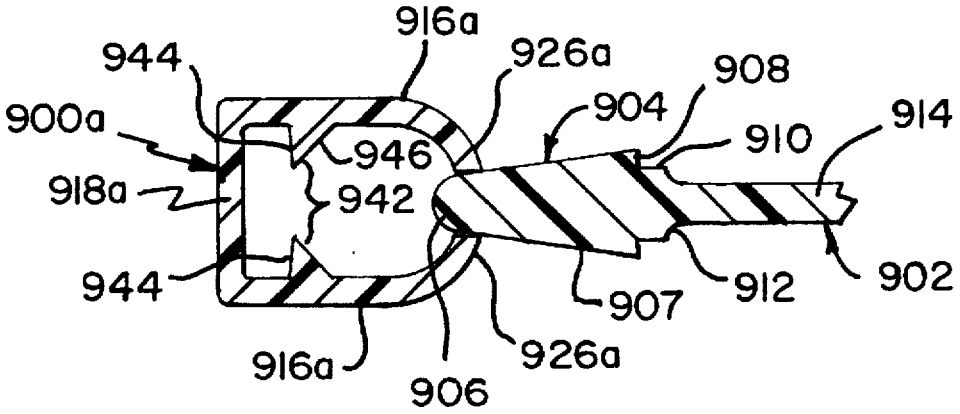
FIGS. 27A to 27C show cross-sectional views of the clip holder of FIGS. 26A to 26C, in combination with a different form of clip, at various stages of mounting the clip on the holder.
Figure 27B:
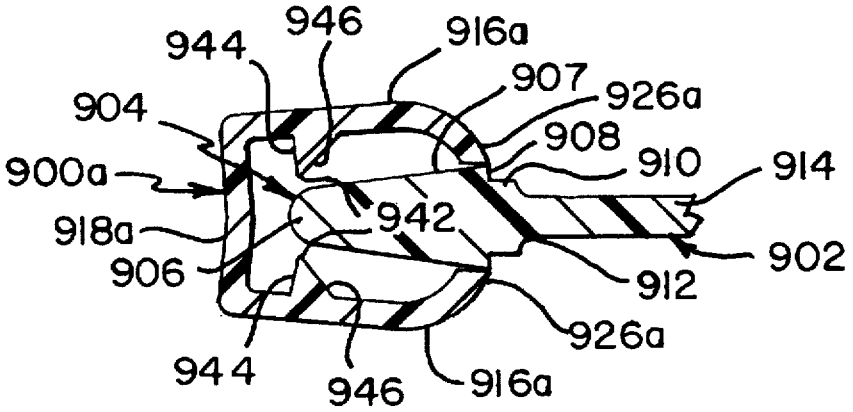
Figure 27C:
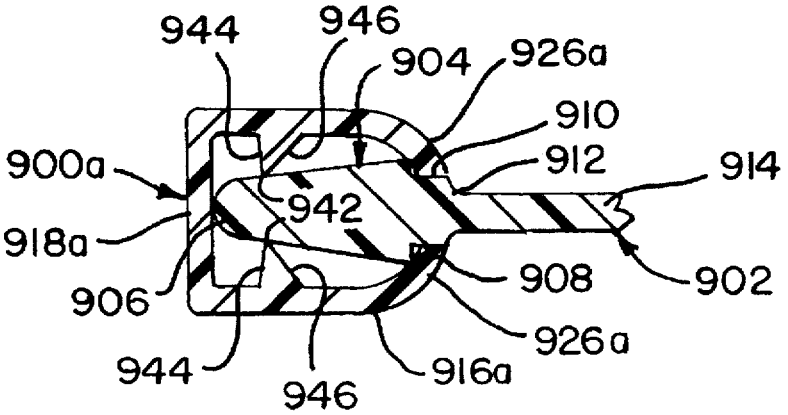

FIGS. 27A, 27B and 27C show progressive stages of applying a different clip 900*a* to the clip holder 904 of FIGS. 26A to 26C. FIG. 27A shows the clip in an essentially unstressed relationship applied at the tip 906 of the tapered region 907 of the clip holder 904. FIG. 27B shows the same parts after the clip has been slid mostly but not entirely onto the tapered portion 907 of the clip holder. FIG. 27C shows the clip 900*a* applied fully to the clip holder 904.

As seen in FIGS. 27A, clip 900*a* has an end wall 918*a* and a pair of generally parallel legs 916*a* forming a channel. The legs 916*a* are dimensioned to be essentially rigid and are not intended to bend, all bending action for permitting separation of the legs 916*a* occurring preferably at the end wall 918*a*. Top wall 918*a* has a thickness at its center in the plane of web 914 which permits elastic and resilient bending, so that legs 916*a* will be spread apart but may be urged together toward one another toward their unstressed state by the resilience of the top wall 918*a*.

Extending inwardly from each of the clip legs 916*a* is a projection 942 which has a wall 944 facing end wall 918*a* and substantially perpendicular to the leg 916*a*. The projection 942 also has an opposite slanted wall 946. The projection 942 is essentially rigid and nonflexible. Each leg 916*a* has its open end curved at 926*a*, with its tip extending essentially perpendicular to the axis of symmetry of the clip cross-section. In this form, the clip 900*a* utilizes less material than the clip shown in FIG. 26 and is more economical to produce.

As in FIG. 26, clip holder 904 has a free edge 906 and a tapered region 904 extending inward from the free edge 906 which is preferably slightly rounded but may be pointed. The inward end of tapered region 904 has a pair of shoulders 908 which lead to a uniform thickness region 910. Shoulders 908 extend substantially perpendicular to the plane of the holder 904. Region 910 then leads inwardly by a smoothly curved section 912 to the web 914, which may be joined to the hanger hook as in the same manner as in FIGS. 4, 5, and 8.

The clip 900*a* is formed as a short section of a plastic extrusion adapted to extend over at least part of the distance between elements 70 shown in FIG. 5 or between hanger rims 26 and 27 shown in FIG. 14.

In the unstressed or relaxed condition of the clip 900*c*, as shown in FIG. 27A, the ends 926*a* of the clip legs are separated by a spacing 923*a* at least as large as the thickness of the tip 906 of the clip holder, but smaller than the maximum thickness of the holder tapered region 907 so that the clip may be readily inserted to straddle over the holder tip with the clip leg ends engaging opposite sides of the holder tapered region 927 as the clip is moved inward of the holder. In the relaxed state, the clip leg ends are spaced apart a distance less than a thickness of the step region 910*a*, so that as the clip ends 926*a* move beyond holder shoulders 908 the resilience of the clip top wall 918*a* will elastically urge the clip ends 926*a* against the step 910, causing the clip ends 926*a* to engage behind the holder shoulders 908 to retain the clip on its holder. As seen in FIG. 26A, the tips of the clip ends 926*a* are essentially perpendicular to the symmetry axis of the clip and are dimensioned to extend substantially to but preferably not beyond the inward edge 912 of step 910, thus, inhibiting any attempt to remove the clip as by lifting one edge as by a fingernail.

As seen in FIG. 27B, as the clip is inserted over the clip holder, the legs ends 926*a* are separated by the increasing width of the clip holder until the tips of the edges of the clip pass the shoulder 908 of the clip holder, allowing the resilience of the top wall 918*a* to cause the legs 926*a* to come together to grip the clip holder at the step 910. In this position, the outer tip 906 of the clip holder is preferably dimension to abut the clip top wall 19A.

Should the clip be attempted to be mounted on the clip holder in a skewed or slanted position, the tip 906 of the tapered first region of the clip holder will engage the slanted wall 946 of one or of the other of the projections 942, and be guided centrally of the channel formed by the clip until the position is shown in FIG. 27C is reached, at which the projection 942 rests on the tapered wall 907 of the clip holder. This feature, in combination with the engagement of the edges 926*a* of the clip with the shoulder 908 of the clip holder, serves to retain the clip on the clip holder, and to inhibit the removal of the clip as by attempting to twist it off the clip holder.

These forms of FIGS. 26 and 27 have the advantage of being relatively simple to implement, since the effort needed to create the molds for producing the clip and holder is reduced by the relative simplicity of the various mold surfaces to be provided.

As indicated above, in each form of the invention, the clip end wall (42, etc.) is preferably made thinner than the clip legs so as to provide a resilient restoring force when the legs are spread. Alternatively, the end wall may have a reduced thickness at its center (as at 230, FIG. 18, or 330, FIG. 19) or at its corners for this purpose.

Accordingly, the present invention provides a garment hanger with an information clip which strongly resists removal from the clip holder portion of the hanger, creating a child-resistant and accident-resistant arrangement.

It will be apparent that minor modifications may be made to the illustrative embodiments described above, by persons of ordinary skill. Therefore, the present invention is to be deemed defined solely by the appended claims.

What is claimed is:

1. In combination a garment hanger and an information clip for mounting around said hanger comprising:

a body portion having a hook member joined to said body at one end of said hook member and having a clip holder portion formed on a web between said hook and body, said web having a free edge and a first region extending inwardly from said free edge and cooperating with an inwardly extending projection on said clip to retain said clip on said holder, said clip having a top wall and a pair of side walls forming a generally U-shaped channel with said side walls curving inwardly at their edges toward one another, said web having a step portion thicker than said web and positioned to have said leg edges rest thereon, said step having a wall located adjacent to said curved leg edges and adapted to inhibit separation of said legs by insertion of a finger nail or the like between said leg and said step.

2. The combination according to claim 1 wherein said wall of said step forms a smooth combination of the outer surface of said curved leg edges.

* * * * *